US009688500B2

(12) United States Patent
Nunn

(10) Patent No.: US 9,688,500 B2
(45) Date of Patent: Jun. 27, 2017

(54) COMPACT DOCUMENT BUNDLER

(71) Applicant: Crane Payment Innovations, Inc., Malvern, PA (US)

(72) Inventor: Michael D. Nunn, West Chester, PA (US)

(73) Assignee: Crane Payment Innovations, Inc., Malvern, PA (US)

( * ) Notice: Subject to any disclaimer, the term of this patent is extended or adjusted under 35 U.S.C. 154(b) by 0 days.

(21) Appl. No.: 14/592,508

(22) Filed: Jan. 8, 2015

(65) Prior Publication Data

US 2016/0200542 A1 Jul. 14, 2016

(51) Int. Cl.
*B65H 33/00* (2006.01)
*B65H 31/26* (2006.01)
(Continued)

(52) U.S. Cl.
CPC ..... *B65H 33/00* (2013.01); *B65H 29/145* (2013.01); *B65H 29/22* (2013.01); *B65H 29/52* (2013.01); *B65H 31/26* (2013.01); *B65H 31/3027* (2013.01); *G07D 11/0003* (2013.01); *B65H 2301/4213* (2013.01); *B65H 2301/42142* (2013.01); *B65H 2301/44331* (2013.01); *B65H 2404/64* (2013.01); *B65H 2404/693* (2013.01); *B65H 2408/13* (2013.01); *B65H 2701/1912* (2013.01)

(58) Field of Classification Search
CPC .... B65H 2301/4223; B65H 2301/4224; B65H 2301/42242; B65H 29/38; B65H 29/40; B65H 29/44; B65H 29/46; B65H 2301/4213; B65H 2404/693
See application file for complete search history.

(56) References Cited

U.S. PATENT DOCUMENTS 5,197,728 A * 3/1993 Radtke ..... B65H 29/52 271/177
5,207,417 A * 5/1993 Bell ..... B65H 29/40 271/175
(Continued)

FOREIGN PATENT DOCUMENTS

EP 1320081 A2 6/2003

OTHER PUBLICATIONS

International Search Report dated May 19, 2016 in connection with International Patent Application No. PCT/US2016/012750; 5 pages.
(Continued)

*Primary Examiner* — Jeremy R Severson

(57) ABSTRACT

A document bundler for a bill validator includes a document path, a transportation unit, and a clamp mechanism. The transportation unit is adapted to move a plurality of documents in series through the document path. The clamp mechanism includes a pushing member. The clamp mechanism is adapted to clamp a first document of the plurality of documents with the pushing member to inhibit movement of the first document by the transportation unit while a second document of the plurality of documents is transported substantially alongside the first document in the document path. The second document residing substantially alongside the first document forms a document bundle. Related apparatus, systems, techniques, and articles are also described.

20 Claims, 10 Drawing Sheets

(51) Int. Cl.

| | |
|---|---|
| ***G07D 11/00*** | (2006.01) |
| ***B65H 29/14*** | (2006.01) |
| ***B65H 29/22*** | (2006.01) |
| ***B65H 29/52*** | (2006.01) |
| ***B65H 31/30*** | (2006.01) |

(56) References Cited

U.S. PATENT DOCUMENTS

| | | | | |
|---|---|---|---|---|
| 5,803,705 | A * | 9/1998 | Keyes | B65H 29/40 271/187 |
| 6,644,657 | B2 * | 11/2003 | Wright | B65H 29/145 271/242 |
| 7,007,946 | B1 | 3/2006 | Dobrindt et al. | |
| 7,959,146 | B2 * | 6/2011 | Gerlier | B65H 29/145 209/534 |
| 8,479,977 | B2 * | 7/2013 | Claghorn | B65H 1/02 235/379 |
| 8,540,227 | B2 * | 9/2013 | Buri | B43M 3/04 270/58.01 |
| 2007/0056453 | A1 * | 3/2007 | Dinnissen | B65H 29/40 101/232 |
| 2014/0231317 | A1 * | 8/2014 | Darmon | B65H 29/60 209/552 |

OTHER PUBLICATIONS

Written Opinion of International Searching Authority dated May 19, 2016 in connection with International Patent Application No. PCT/US2016/012750; 6 pages.

* cited by examiner

COMPACT DOCUMENT BUNDLER

TECHNICAL FIELD

The subject matter described herein relates to a compact document bundler for use with, for example, a bill validator.

BACKGROUND

A currency detector or currency validator is a device that determines whether bills are genuine or counterfeit. These devices can be used in many automated machines found in retail kiosks, self-checkout machines, gaming machines, transportation parking machines, automatic fare collection machines, vending machines, and the like. In addition to accepting currency, currency validators may dispense currency, for example, to provide change for a retail transaction or "cash-back" to a customer. Bills may be dispensed one at a time, but this requires the user to remove each bill before the next bill can be dispensed, which is time consuming and requires excessive user interaction with the currency validator.

SUMMARY

In an aspect, a document bundler for a bill validator includes a document path, a transportation unit, and a clamp mechanism. The transportation unit is adapted to move a plurality of documents in series through the document path. The clamp mechanism includes a pushing member. The clamp mechanism is adapted to clamp a first document of the plurality of documents with the pushing member to inhibit movement of the first document by the transportation unit while a second document of the plurality of documents is transported substantially alongside the first document in the document path. The second document residing substantially alongside the first document forms a document bundle.

In another aspect, a document bundler for a bill validator includes a pushing member and an extendable arm. The pushing member includes a first pushing surface and a second surface opposite the first pushing surface. The extendable arm is connected to the pushing member and is rotatable through a first trajectory from a retracted position to an extended position. The first trajectory passes the pushing member from the retracted position through at least a portion of a document path to press, in the extended position, the first pushing surface of the pushing member against a first document residing within the document path. The extendable arm is adapted to inhibit movement of the first document residing within the document path when in the extended position. The extendable arm is rotatable through a second trajectory different from the first trajectory from the extended position to the retracted position.

In yet another aspect, a document bundling system includes a document path, a transportation unit, a clamp mechanism including a pushing member extendable into the document path, and at least one data processor and memory storing instructions which, when executed by the at least one data processor, causes the at least one data processor to perform operations. Successive documents are transported by the transportation unit in series through the document path to a bundling position. The pushing member is extended by the clamping member from an unclamped position into the document path to clamp the documents in the document path at the bundling position to inhibit their movement by the transportation unit while a next successive document is transported through the document path to the bundling position to reside alongside the clamped documents. The pushing member is retracted by the clamp mechanism around the next successive document residing alongside the clamped documents in the document path to unclamp the documents in the document path and the pushing member is returned to the unclamped position without inhibiting movement of the next successive document.

One or more of the following features can be included in any feasible combination. For example, the clamp mechanism can be adapted to clamp successive documents of the plurality of documents while a next document is transported alongside the clamped documents to add the next document to the document bundle. The transportation unit can include a drive wheel and a pinch wheel configured to push documents against the drive wheel. The drive wheel can slip on the first document when movement of the first document is inhibited by the clamp mechanism. The pushing member can include a first pushing surface and a second smooth surface opposite the first pushing surface. The first pushing surface can have a coefficient of friction that is greater than a coefficient of friction of the second smooth surface. The clamp mechanism can include an extendable arm having a first arm segment pivotably attached to a second arm segment at a first end of the second arm segment. The second arm segment can be attached to the pushing member at a second end opposite the first end of the second arm segment.

The pushing member can clamp a trailing edge of the first document. The clamp mechanism can be adapted to clamp the first document between the pushing member and a wall of the document path. The document path can include a recess adjacent the clamp mechanism and the clamp mechanism clamps the first document within the recess. The clamp mechanism can include an extendable arm connected to the pushing member for extending the pushing member across the document path to clamp the first document. The pushing member can extend across the document path by rotating through the document path. The extendable arm can be adjacent the document path so that documents transported by the transportation unit are unobstructed by the extendable arm when the extendable arm is extended across the document path. The extendable arm can include an opening located so that documents transported by the transportation unit pass through the opening when the extendable arm is extended across the document path.

The second trajectory can pass in an arc through the document path from the extended position to the retracted position. The extendable arm can include a first arm segment pivotably attached to a second arm segment at a first end of the second arm segment. The second arm segment can be attached to the pushing member at a second end opposite the first end of the second arm segment. Two or more documents residing alongside at a position can form a document bundle. The document bundle can be transported to an exit of the document path for dispensing the document bundle.

Computer program products are also described that comprise non-transitory computer readable media storing instructions, which when executed by at least one data processor of one or more computing systems, causes at least one data processor to perform operations herein. Similarly, computer systems are also described that may include one or more data processors and a memory coupled to the one or more data processors. The memory may temporarily or permanently store instructions that cause at least one processor to perform one or more of the operations described herein. In addition, methods can be implemented by one or more data processors either within a single computing system or distributed among two or more computing systems.

The subject matter described herein provides many advantages. For example, in some implementations, documents can be bundled in a compact space within a document validator minimizing the size of the document validator. Moreover, existing document validators can be modified to bundle documents for dispensing (e.g., retrofit). Additionally, bundling documents can increase the transaction speed of a point of sale machine, thereby increasing revenue, profitability, and customer experience.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

Like reference symbols in the various drawings indicate like elements.

DETAILED DESCRIPTION

The current subject matter includes a compact document bundler that uses a document path, for example, of a document validator, to store and bundle a number of bills before dispensing them in a bundle to the user. In some implementations, a bundle with one or more documents within the document path can be clamped to a wall of the path to inhibit movement while another document is transported alongside the bundle to add the document to the bundle. The process can continue until a bundle is formed with the desired number of documents and the bundle can be dispensed to a user. The current subject matter can be compact to fit in existing document validators.

Documents can include, for example, banknotes, bills, checks, valuable papers, currency, coins, tokens, certificates, coupons, tickets, valuable items, and the like.

Figure 1:
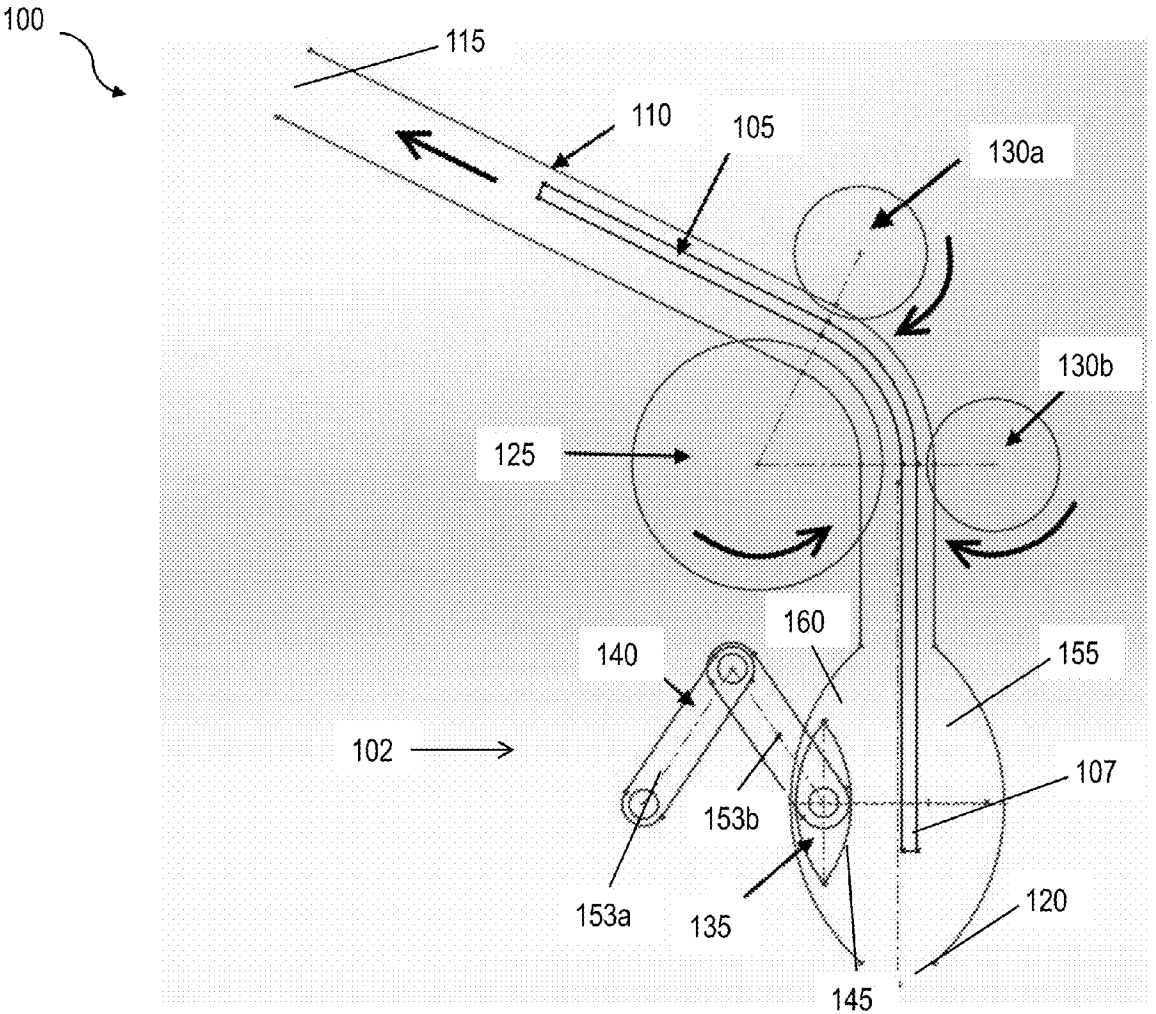
FIG. 1 is a schematic illustrating an example implementation of a compact document bundler for use in a document validator.

FIG. 1 is a schematic illustrating an example implementation of a compact document bundler 100 for use in a document validator. The validator can include document path 110 through which documents can move. The document path 110 can include entrance/exit end 115, for example, for receiving and dispensing a document 105 to a user. The document path 110 can also include storage end 120 that leads to one or more storage compartments, such as a document cassette. A transportation unit can include drive wheel 125 and pinch wheels 130*a* and 130*b* for transporting the document 105 through the document path 110. The transportation unit can transport multiple documents in series through the document path 110. The pinch wheels 130*a* and 130*b* press the document 105 against the drive wheel 125, which actively rotates to pull the document 105 through the document path 110.

The document bundler 100 can include clamp mechanism 102 with pushing member 135 and extendable pushing arm 140 for clamping documents 105 within the document path 110. The pushing member 135 can include pushing surface 145 with a rough surface, such as a surface with a higher coefficient of friction for griping documents with the pushing surface 145. The pushing member 135 can include smooth surface 150 opposite the pushing surface 145 with a lower coefficient of friction to allow documents to slide past the smooth surface 150 of the pushing member 135.

Figure 7B:
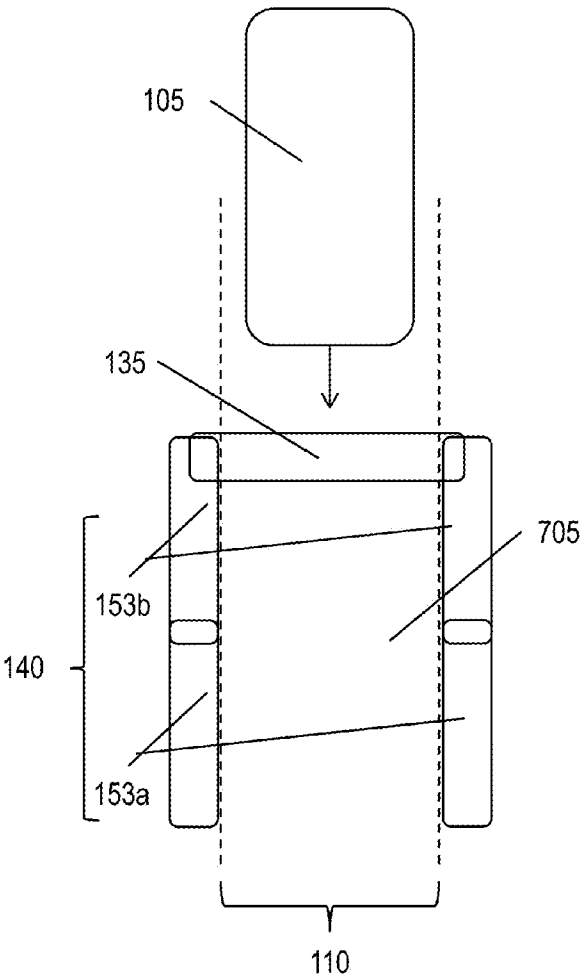
FIG. 7B is a top view of a schematic diagram of another example implementations of a clamp mechanism.
Figure 7A:
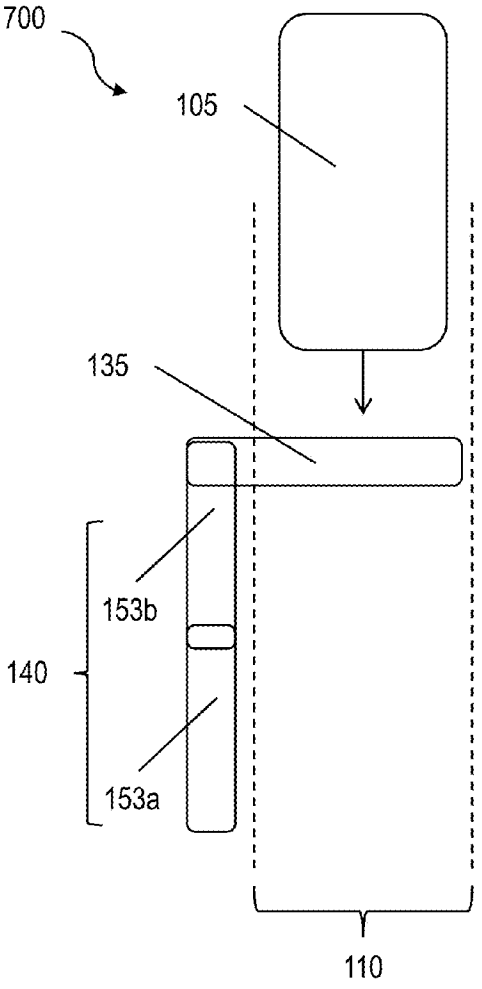
FIG. 7A is a top view of a schematic diagram of the clamp mechanism and document path.

The pushing arm 140 can include two arm segments (first arm segment 153*a* and second arm segment 153*b*) that are pivotably attached to one another via a fastener at ends of their respective arms. The second arm segment 153*b* can be pivotably attached to the pushing member 135 via a fastener. The pushing arm 140 can extend the pushing member 135 into and retract the pushing member 135 from the document path 110. The pushing arm 140 may be adjacent the document path 110 so as to not obstruct the document path 110. For example, FIG. 7A is a top view of a schematic diagram of the clamp mechanism 102 and document path 110. The pushing arm 140 is fully extended and documents 105 transported through the document path 110 are unobstructed by the pushing arm 140. FIG. 7B is a top view of a schematic diagram of another example implementations of a clamp mechanism 102. The extendable pushing arm 140 defines an opening 705 located so that documents 105 transported by the transportation unit are unobstructed by the pushing arm 140.

Referring again to FIG. 1, the document path 110 can include clamp mechanism recess 160 for the pushing member 135 to reside when the pushing member 135 is retracted. The document path 110 can also include a clamp area or recess 155 for the pushing member 135 to clamp a tail end 107 of the document 105 against the wall of the document path 110. In some implementations, the clamp mechanism recess 160, the document path 110, and the clamping area or recess 155 can form a clamping chamber.

Figure 2:
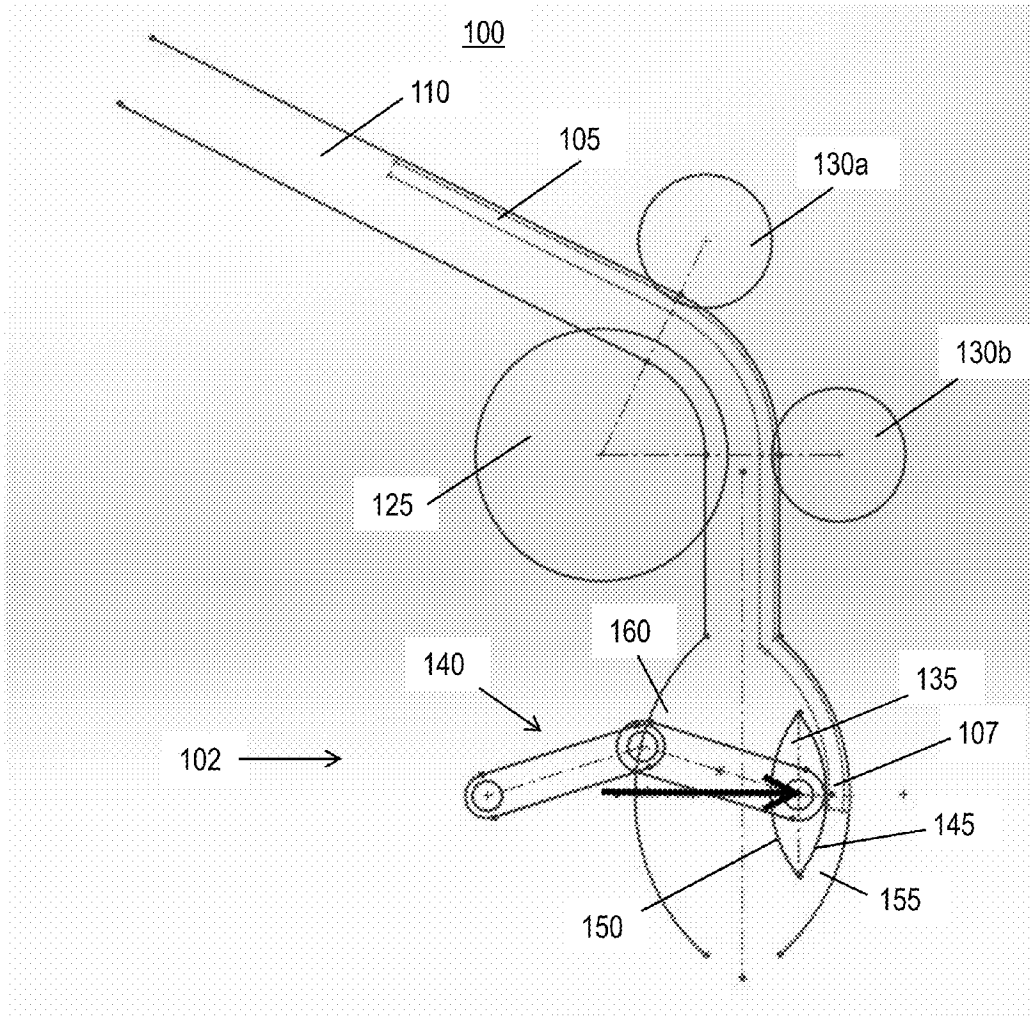
FIG. 2 is a schematic cross section view illustrating the clamp mechanism with the pushing member extended to clamp the document against the document path wall and in a recess.

Once drive wheel 125 and pinch wheels 130*a* and 130*b* transport the document 105 transported to bring the tail end 107 of the document 105 alongside the clamp mechanism 102 (e.g., a clamping position), the pushing member 135 can extend. The pushing member 135 can push the tail end 107 of the document 105 across the document path 110. FIG. 2 is a schematic cross section view illustrating the clamp mechanism 102 with the pushing member 135 extended to clamp the document 105 against the document path 110 wall and in the clamp recess 155. The clamp mechanism 102 can pin the document 105 within the clamp recess 155 with sufficient force to inhibit the document 105 from moving, even when drive wheel 125 is driven (e.g., spins). While the clamp mechanism 102 is pinning the document 105, if the drive wheel 125 is driven, then the drive wheel 125 can slide relative to the stationary document 105.

Figure 3:
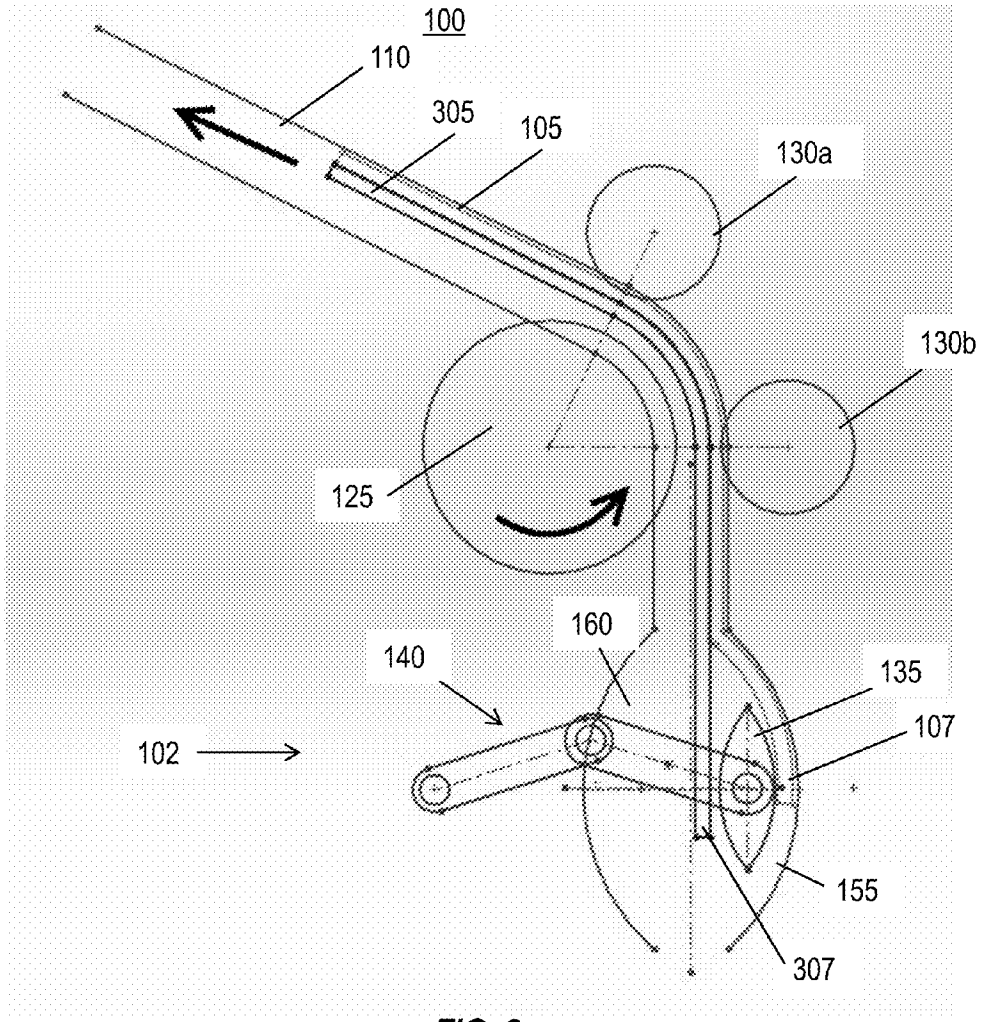
FIG. 3 is a cross section view of a schematic of the document bundler with second document being transported alongside the stationary first document.

FIG. 3 is a cross section view of a schematic of the document bundler 100 with second document 305 being transported alongside the stationary first document 105. The second document 305 is driven by drive wheel 125 alongside the first document 105 during which the second document 305 slides along the side of the first document 105. Pinch wheels 130*a* and 130*b*, pressing against the stationary first document 105, do not spin. The smooth surface 150 of the extended pushing member 135 allows the second document 305 to slide past the pushing member 135 unimpeded.

Figure 4:
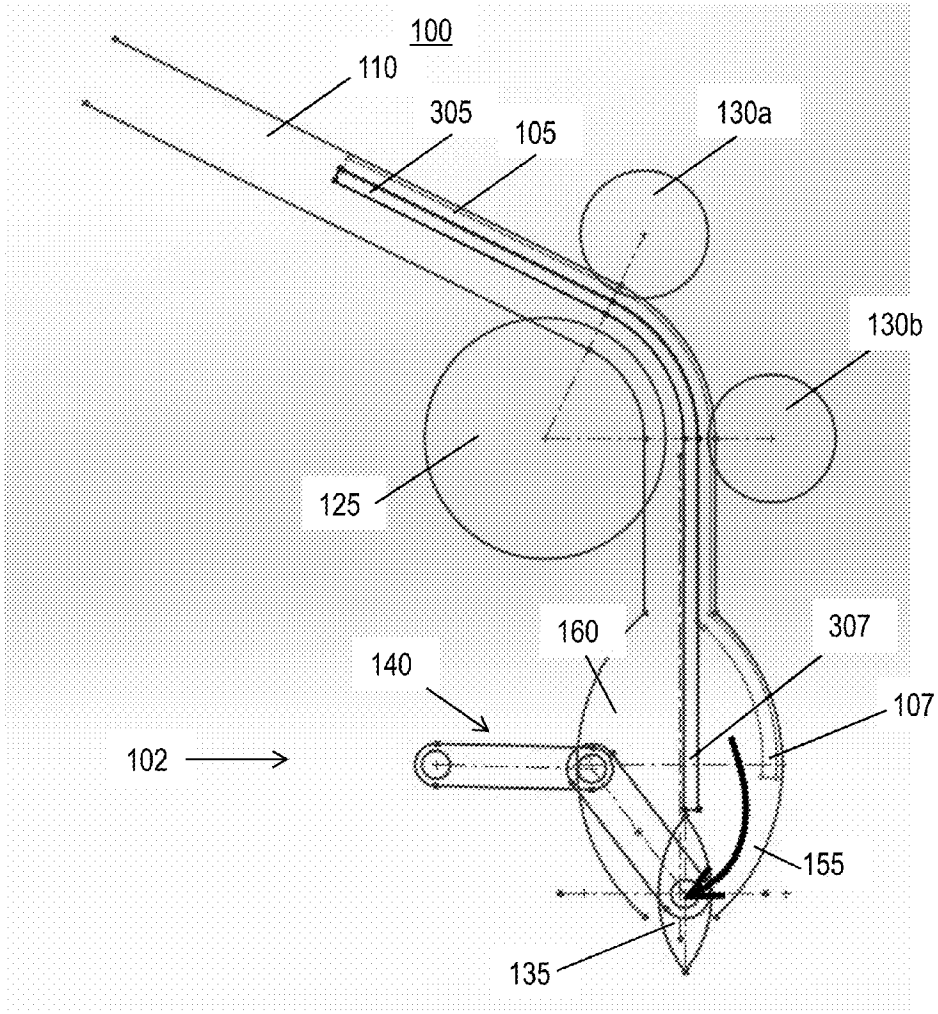
FIG. 4 is a cross section view of the schematic of the document bundler with the clamp mechanism articulating pushing member around the second document to return to its starting position.

FIG. 4 is a cross section view of the schematic of the document bundler 100 with the clamp mechanism 102 articulating pushing member 135 around the second document 305 to return to its starting position. The clamp mechanism 102 articulates the pushing member 135 in such a manner that the pushing member 135 and pushing arm 140 clear the trailing edge 307 of the second document 305. In the example implementation shown in FIG. 4, the pushing member 135 is moved in a trajectory or an arc around and clearing the trailing edge 307. The trajectory of the pushing member 135 when moving from the starting position to the clamped position can be different from the trajectory of the pushing member 135 when moving from the clamped position back to the starting position.

Figure 5:
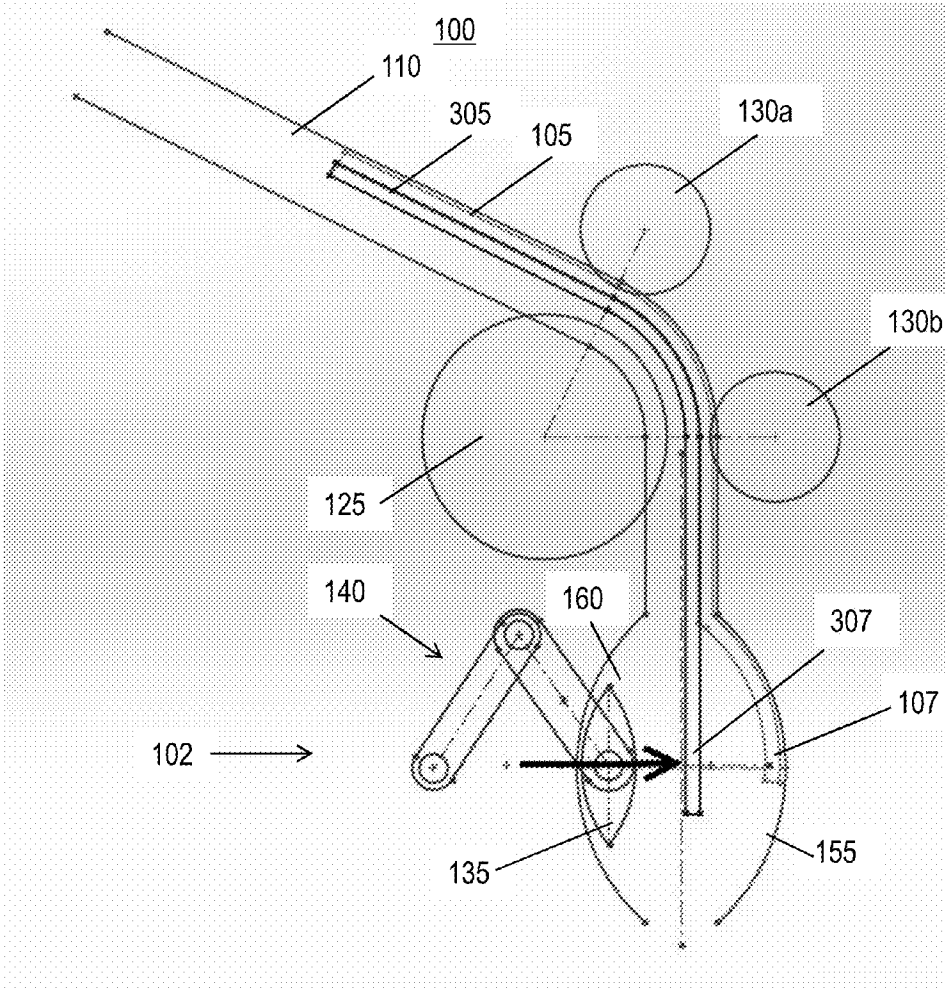
FIG. 5 is a cross section view of the schematic of the document bundler with the pushing member returned to its starting position and beginning to move.
Figure 6:
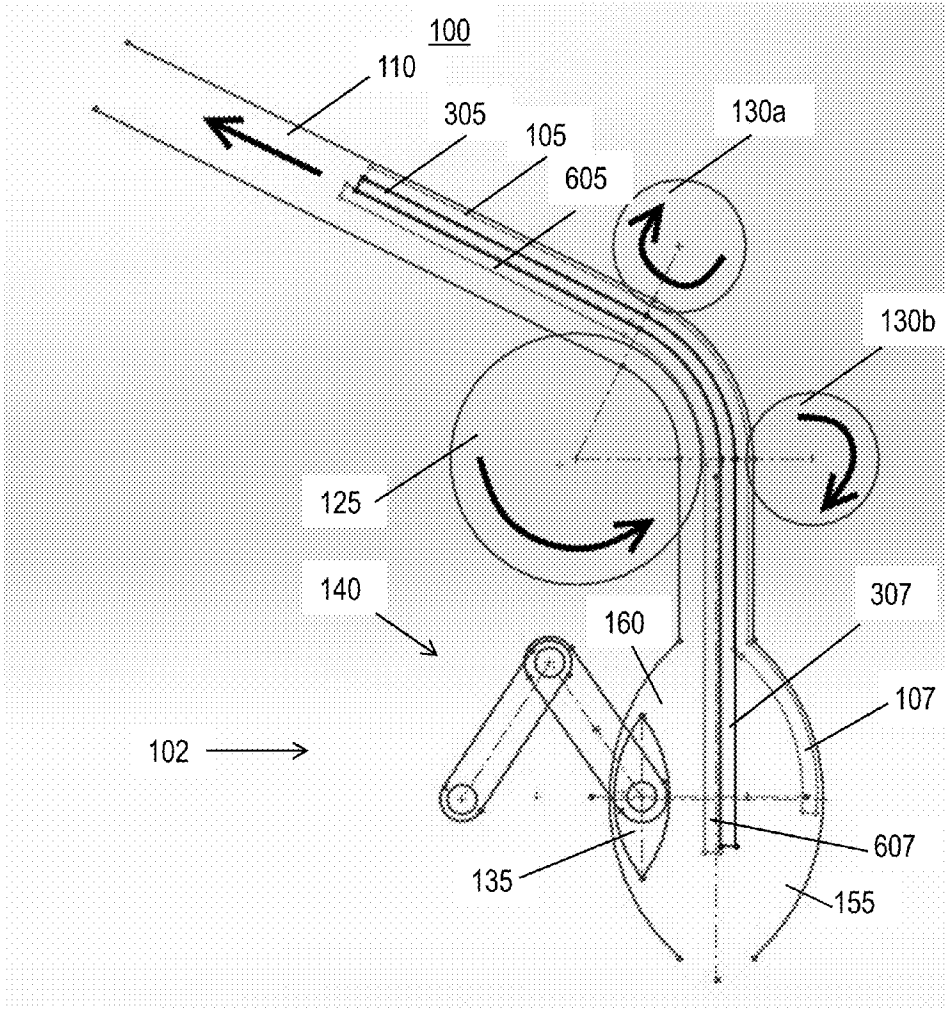
FIG. 6 is a cross section view of the schematic of the document bundler with pushing member returned to its starting position.

FIG. 5 is a cross section view of the schematic of the document bundler 100 with the pushing member 135 returned to its starting position and beginning to move. Clamp mechanism 102 is beginning to extend to pin the first and second documents (105 and 305, respectively) to the document path 110 wall. Specifically, the pushing member 135 pins the second document 305 to the first document 105, which is pinned to the wall of the document path 110. The two documents (first document 105 and second document 305) form a bundle of documents that can be dispensed from the entrance/exit end 115 of the document path 110 to a user. The process can repeat to add additional documents to the document bundle. For example, FIG. 6 is a cross section view of the schematic of the document bundler 100 with pushing member returned to its starting position. In FIG. 6, a third document 605 has been brought into the document path 110. The three documents (first document 105, second document 305, and third document 605) form a document bundle that can be dispensed from the entrance/exit end 115 of the document path 110 to a user.

Figure 8:
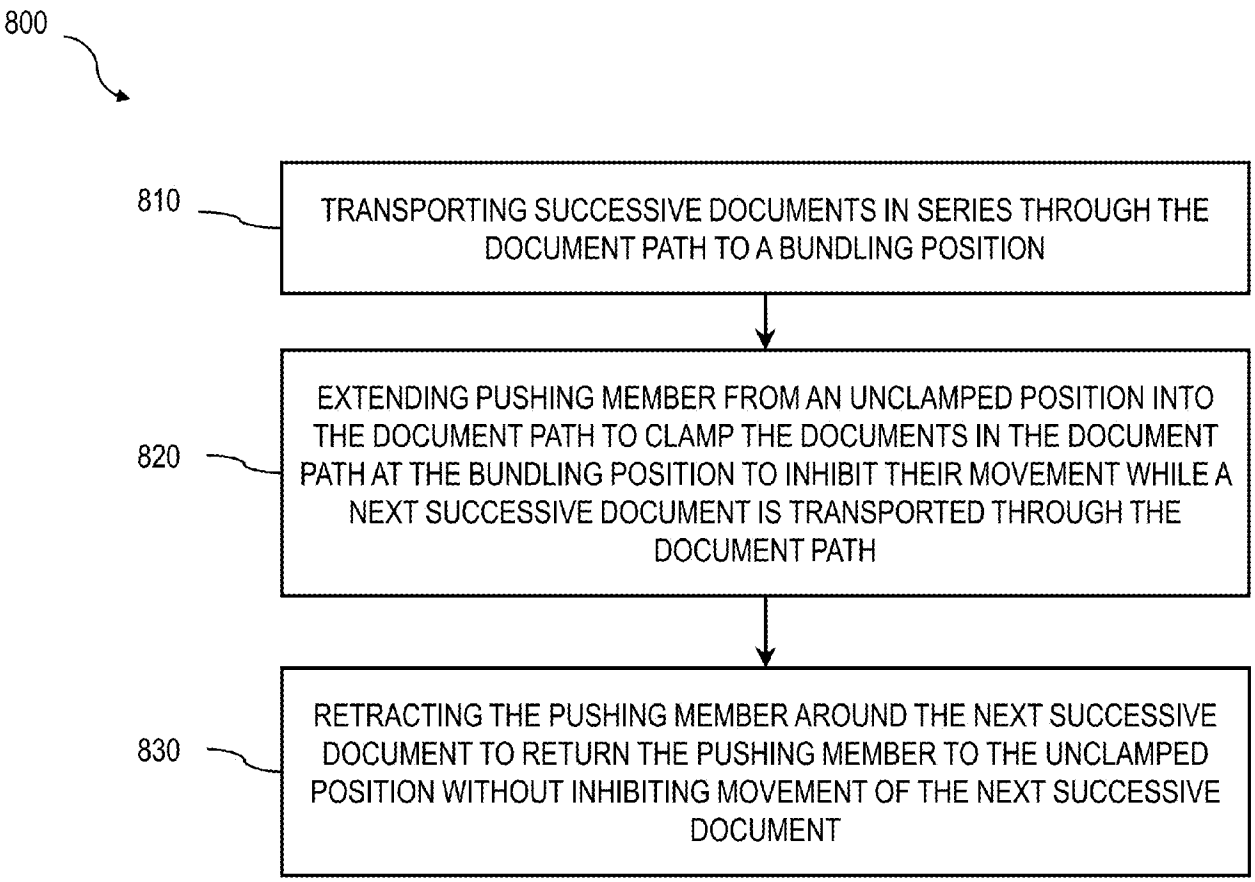
FIG. 8 is a process flow diagram illustrating a method of bundling documents.

FIG. 8 is a process flow diagram illustrating a method 800 of bundling documents. Successive documents can, at 810, be transported via a transportation unit in series through a document path to a bundling position. The document path can be, for example, in a document validator.

The clamp mechanism can extend, at 820, an extendable pushing member from an unclamped position into the document path to clamp the documents in the document path at the bundling position to inhibit their movement by the transportation unit while a next successive document is transported through the document path to the bundling position to reside alongside the clamped documents.

The pushing member can, at 830, be retracted by the clamp mechanism. The pushing member can be retracted around the next successive document while it resides alongside the clamped documents in the document path. The clamp mechanism can unclamp the documents previously clamped in the document path and return the pushing member to the unclamped position without inhibiting movement of the next successive document.

Figure 9:
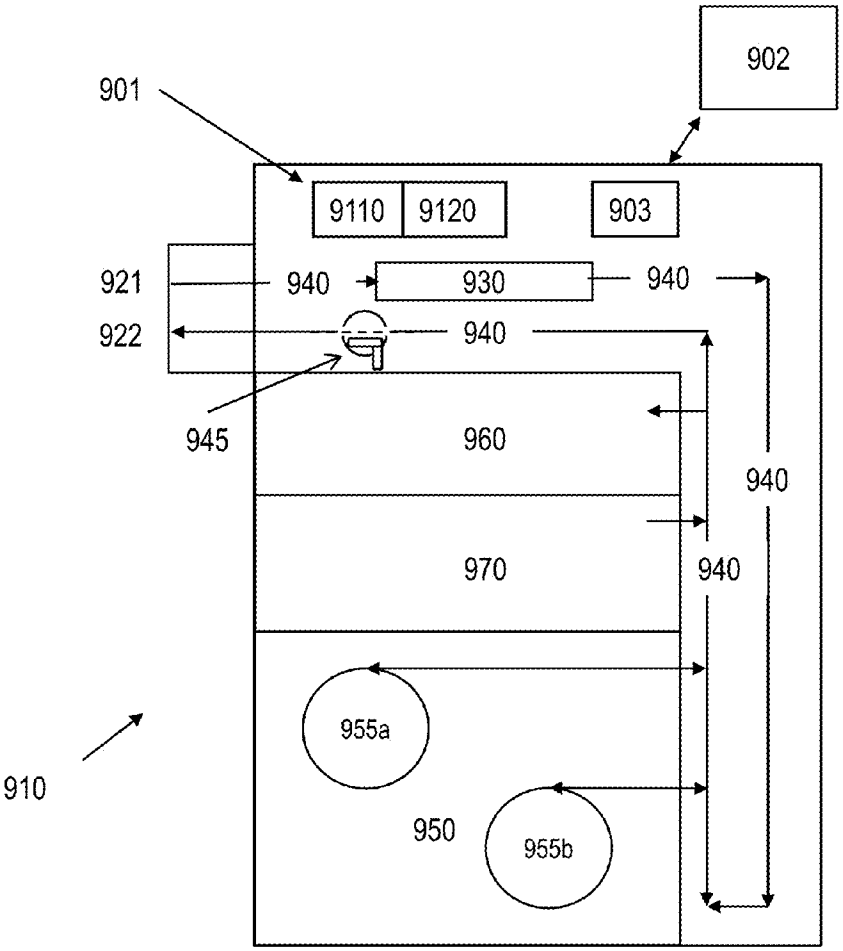
FIG. 9 is a cutaway view of an example implementation of a document validator (e.g., a bill validator) with clamp mechanism.

FIG. 9 is a cutaway view of an example implementation of a document validator or document handler 910 (e.g., a bill validator) with clamp mechanism 945. The document handler 910 can be configured for recognizing a document as genuine or counterfeit, classifying documents, and dispensing documents in a bundle form. The document handler 910 includes a document inlet/outlet 920 for receiving documents, an authentication unit 930 for authenticating documents, a transportation mechanism 940 for transporting documents to and from various components within the document handler 910, and one or more document storage units 950 capable of receiving, storing, and dispensing documents. Authentication unit 930 can classify input documents as having a class that is one of several classes (e.g., determining a denomination of the document). In some implementations, document handler 910 can further include a document cassette 960 (e.g., cashbox) for receiving and storing documents. Document cassette 960 can be a one-way storage device for documents such that document handler 910 cannot extract documents contained in the document cassette 960. The clamp mechanism 945 can operate to bundle documents during dispensing of the documents from the document validator 900, for example, as described above with reference to FIGS. 1-8.

Document handler 910 can further include a controller 901 for controlling the overall operation of the money-handling unit. Controller 901 can include a microprocessor 9110 and memory 9120 for processing and storing instructions to operate document handler 910. Controller 901 can be adapted to determine how each inserted banknote is handled (e.g., where it should be stored or whether it should be returned to the user), and for controlling components of the document handler 910 (e.g., components 930, 940, 950, 960, and/or 970) coupled thereto to accomplish movement of documents into, through and out of document handler 910.

The document storage unit 950 can be mounted to document handler 910 and can include a first recycler drum 955*a* (e.g., two-way storage) and a second recycler drum 955*b* (e.g., two-way storage). Inlet/outlet 920 is coupled to transportation mechanism 940 such that documents inserted into inlet/outlet 920 are received by the transportation mechanism 940.

In some implementations, authentication unit 930 uses an optical sensing unit to discriminate the document (e.g., to discriminate between genuine vs. non-genuine items, or to classify the items) and determine other characteristics of the document (e.g., condition, degree of soiling, rips, tears, holes, and the like). The optical sensing unit can be of any type (e.g., spectral reflection and/transmission). Alternatively, the sensing unit can be any other type of document sensing system (e.g., magnetic sensing, physical sensing, and the like). Authentication unit 930 can be configured to sense and discriminate documents and/or it can be arranged to provide sensed data to a controller 901 for further processing.

In some implementations, transportation mechanism 940 can operatively couple inlet/outlet 920 to the authentication unit 930. Transportation mechanism 940 can include a series of belts driven by an actuator to cause documents to move in an inward and outward direction relative to the entry and exit of the document handler 910. Transportation mechanism 940 can be further coupled to document storage unit 950 for transporting documents to and from the document storage unit 950 based on the desired operation of document handler 910. In some implementations, transportation mechanism 940 can include one continuous transportation path arranged to move in forward or backward motion (or capable of moving in both the forward and backward directions). In other implementations, transportation mechanism 940 can be comprised of a series of smaller transportation units to create a continuous transportation path. Other types of transportation mechanisms can be adapted for use within the document handler 910.

In some implementations, document cassette 960 can be configured to store documents identified by the document handler 910 to be held within document cassette 960 for later removal by an authorized individual. In some implementations, documents stored in the document cassette 960 have to be removed from the document cassette 960 when it is external to the document handler 910.

In some implementations, a loading unit 970 can be included for providing at least one item of currency to the document handler 910 for use as change in a transaction. Loading unit 970 can be removably mounted to document handler 910 and can be operatively coupled to transportation mechanism 940. Loading unit 970 can be configured as a one-way storage device for documents such that the document handler 910 can extract documents contained in the loading unit 970 but cannot store documents in the document loading unit 970.

In some implementations, controller 901 includes an external access for communicating with an external component 902 (e.g., handheld service tool or remote computer). In other implementations, document handler 910 includes a communications unit 903 for communicating with remote devices for receiving updates and/or service information.

Figure 10:
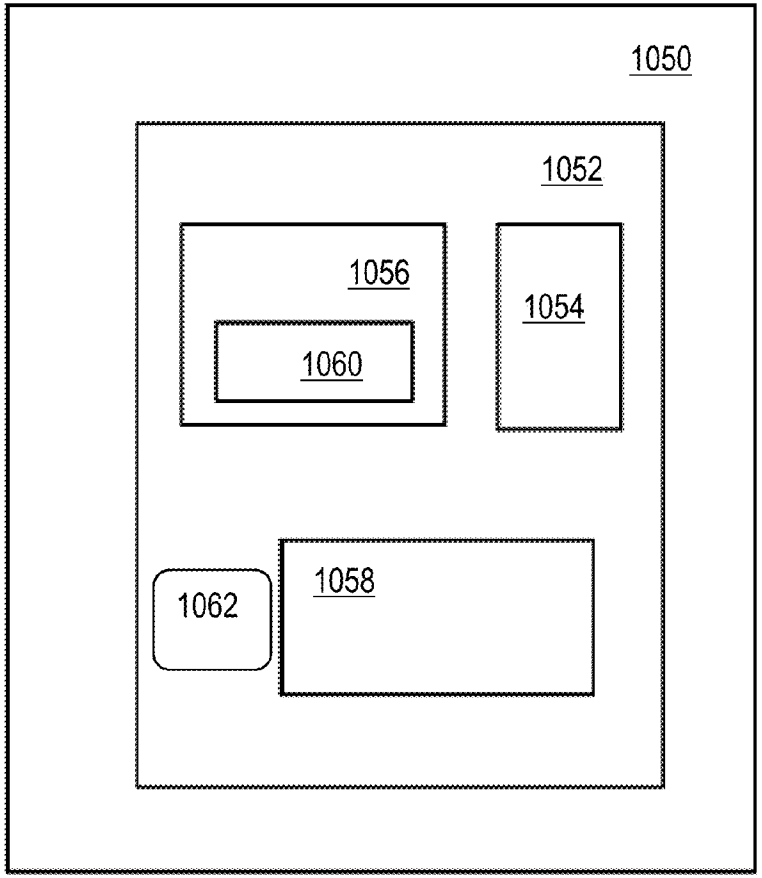
FIG. 10 is a block diagram illustrating an example automated transaction machine that includes a validator for discriminating between an unknown item of currency and at least one known denomination (or class).

FIG. 10 is a block diagram illustrating an example automated transaction machine 1050 that includes a validator 1052 for discriminating between an unknown item of currency and at least one known denomination (or class). The validator 1052 can be configured for recognizing a document as genuine or counterfeit, classifying documents, and assessing document fitness. The validator 1052 can include a sensing unit 1054, memory 1056, and processing unit 1058, including at least one data processor, such as a microprocessor. The validator 1052 can store spectral response information 1060 of at least one known document for comparison with an inserted document. The validator 1052 can include a bundler 1062 for bundling documents for dispensing from the automated transaction machine 1050.

Various implementations of the subject matter described herein may be realized in digital electronic circuitry, integrated circuitry, specially designed ASICs (application specific integrated circuits), computer hardware, firmware, software, and/or combinations thereof. These various implementations may include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and may be implemented in a high-level procedural and/or object-oriented programming language, and/or in assembly/machine language. As used herein, the term "machine-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

Although a few variations have been described in detail above, other modifications are possible. For example, the document 105 may be clamped at different locations on the document 105 (e.g., the leading edge, the middle, and the like). Additionally, the clamp mechanism 102 and associated recesses can be located at different locations along the document path 110 and may be located within the document validator or within another component along the document path 110. The transportation unit can include belts or other features for transporting the document 105. In some implementations, the pushing member 135 can rotate as it travels across the bill path (e.g., in a clockwise motion that enables it to rotate down and under the document when it returns to the starting position). The pushing member 135 is not limited to an arm with one pushing member but can include a rotating gate having two pushing members that swap places as the gate rotates 180 degrees within recesses 155 and 160.

Furthermore, the implementations described above can be directed to various combinations and subcombinations of the disclosed features and/or combinations and subcombinations of several further features disclosed above. In addition, the logic flows depicted in the accompanying figures and described herein do not require the particular order shown, or sequential order, to achieve desirable results. Other embodiments may be within the scope of the following claims.

What is claimed is:

1. A document bundler for a bill validator, the document bundler comprising:

a document path comprising a wall;

a transportation unit adapted to move a plurality of documents in series along the wall of the document path; and a clamp mechanism comprising a pushing member, the clamp mechanism adapted to clamp a first document of the plurality of documents with the pushing member to inhibit movement of the first document by the transportation unit while a second document of the plurality of documents is transported substantially alongside the first document in the document path, the second document residing substantially alongside the first document forming a document bundle, wherein the clamp mechanism is adapted to clamp the first document between the pushing member and the wall of the document path.

2. The document bundler of claim 1, wherein the clamp mechanism is adapted to clamp successive documents of the plurality of documents while a next document is transported alongside the clamped documents to add the next document to the document bundle.

3. The document bundler of claim 1, wherein the transportation unit comprises a drive wheel and a pinch wheel configured to push documents against the drive wheel, wherein the drive wheel slips on the first document when movement of the first document is inhibited by the clamp mechanism.

4. The document bundler of claim 1, wherein the pushing member includes a first pushing surface and a second smooth surface opposite the first pushing surface, the first pushing surface having a coefficient of friction that is greater than a coefficient of friction of the second smooth surface.

5. The document bundler of claim 1, wherein the clamp mechanism further comprises an extendable arm having a first arm segment pivotally attached to a second arm segment at a first end of the second arm segment, the second arm segment attached to the pushing member at a second end opposite the first end of the second arm segment.

6. The document bundler of claim 1, wherein the pushing member clamps a trailing edge of the first document.

7. The document bundler of claim 1, wherein the document path includes a recess adjacent the clamp mechanism and the clamp mechanism clamps the first document within the recess.

8. The document bundler of claim 1, wherein the clamp mechanism further comprises an extendable arm connected to the pushing member for extending the pushing member across the document path to clamp the first document.

9. The document bundler of claim 8, wherein the pushing member extends across the document path by rotating through the document path.

10. The document bundler of claim 8, wherein the extendable arm is adjacent the document path so that documents transported by the transportation unit are unobstructed by the extendable arm when the extendable arm is extended across the document path.

11. The document bundler of claim 8, wherein the extendable arm includes an opening located so that documents transported by the transportation unit passes through the opening when the extendable arm is extended across the document path.

12. The document bundler of claim 1, wherein the document path comprises an exit for dispensing the document bundle.

13. A document bundler for a bill validator, the document bundler comprising:

a pushing member having a first pushing surface and a second surface opposite the first pushing surface; and an extendable arm connected to the pushing member and rotatable through a first trajectory from a retracted position to an extended position, the first trajectory passing the pushing member from the retracted position through at least a portion of a document path to press, in the extended position, the first pushing surface of the pushing member against a first document residing within the document path, the extendable arm adapted to inhibit movement of the first document residing within the document path when in the extended position, and the extendable arm rotatable through a second trajectory along a different path from the first trajectory from the extended position to the retracted position.

14. The document bundler of claim 13, wherein the second trajectory passes in an arc through the document path from the extended position to the retracted position.

15. The document bundler of claim 13, wherein the extendable arm comprises a first arm segment pivotally attached to a second arm segment at a first end of the second arm segment, the second arm segment attached to the pushing member at a second end opposite the first end of the second arm segment.

16. The document bundler of claim 13, wherein the first pushing surface has a coefficient of friction that is greater than a coefficient of friction of the second surface.

17. The document bundler of claim 13, wherein the document path comprises an exit for dispensing the document bundle.

18. A document bundling system comprising a document path, a transportation unit, a clamp mechanism comprising a pushing member extendable into the document path, at least one data processor and memory storing instructions which, when executed by the at least one data processor, causes the at least one data processor to perform operations comprising:

transporting, by the transportation unit, successive documents in series through the document path to a bundling position;

extending, by the clamp mechanism, the pushing member from an undamped position into the document path to clamp the documents in the document path at the bundling position to inhibit their movement by the transportation unit while a next successive document is transported through the document path to the bundling position to reside alongside the clamped documents, wherein the clamp mechanism is adapted to clamp the documents between the pushing member and a wall of the document path; and retracting, by the clamp mechanism, the pushing member around the next successive document residing alongside the clamped documents in the document path to unclamp the documents in the document path and return the pushing member to the undamped position without inhibiting movement of the next successive document.

19. The document bundling system of claim 18, wherein two or more documents residing alongside at the clamping position form a document bundle.

20. The document bundling system of claim 19, the operations further comprising:

transporting the document bundle to an exit of the document path for dispensing the document bundle.

* * * * *